United States Patent [19]

Sorimachi

[11] 4,227,726

[45] Oct. 14, 1980

[54] DOOR OPERATING EQUIPMENT

[75] Inventor: Akira Sorimachi, Yokohama, Japan

[73] Assignee: Katoh Electrical Machinery Co., Ltd., Yokohama, Japan

[21] Appl. No.: 10,959

[22] Filed: Feb. 9, 1979

[30] Foreign Application Priority Data

Mar. 20, 1978 [JP] Japan ..... 53/31907

[51] Int. Cl.[3] ..... E05C 17/56

[52] U.S. Cl. ..... 292/251.5; 292/DIG. 4; 292/DIG. 72

[58] Field of Search ..... 292/DIG. 4, DIG. 72, 292/251.5, 144

[56] References Cited

U.S. PATENT DOCUMENTS

| | | | |
|---|---|---|---|
| 3,492,037 | 1/1970 | Hutchinson | 292/251.5 |
| 4,026,588 | 5/1977 | Bishing et al. | 292/251.5 |

FOREIGN PATENT DOCUMENTS

| | | | |
|---|---|---|---|
| 70861 | 10/1975 | Australia | 292/251.5 |
| 1254687 | 1/1961 | France | 292/251.5 |

*Primary Examiner*—Richard E. Moore

*Attorney, Agent, or Firm*—George B. Oujevolk

[57] ABSTRACT

A door operating mechanism holds a door in a closed position and automatically opens the door of a console which contains an electric audio apparatus such as a stereo. When the door is first pushed to a close, the door operating mechanism which is inside a plate of the console and which has a front end portion which extends out from the plate holds the door magnetically and when the door is pushed again an operative member slidably mounted in a cylindrical casing of the door operating mechanism pushes the door with a pop to open it automatically. The door is thus held in a closed position but pops open when the door is pushed again.

4 Claims, 6 Drawing Figures

DOOR OPERATING EQUIPMENT

BACKGROUND OF THE INVENTION

This invention relates to a door operating mechanism adapted to be used in an electrical audio apparatus such as a stereo and more particularly to a door operating mechanism which will throw open the door when the door is pushed.

BRIEF DESCRIPTION OF THE PRIOR ART

According to the conventional door operating equipment, when the door is first pushed closed by hand, the operative member of the equipment is pushed and latched by a push-latch mechanism. The door is held at the closed position by means of the magnetic force between the magnet and the magnetic metal piece on the door. When the door is again pushed, the engagement between the operative member and the push-latch mechanism is released, the operative member pushes the door a little in the open direction by means of a coil comprssion spring. However, as the magnet and the magnetic metal piece on the door are not separated by some sort of reverse magnetic force or lessening of the magnetic force, it is necessary to forcibly pull open the door. If the magnetic coupling between the magnet and the magnetic material on the door is made weak so as to facilitate the opening of the door, the door is not held stably. This is particularly so when the door is made of a glass pane since glass is very heavy.

Additionally, the conventional door operating mechanism is disposed on the inside of the console and is bulky. When the console is taken apart for shipment and packed, the plates making up the console overlap one another. The door operating mechanism which extends out from the plate therefore interferes with the packing.

SUMMARY OF THE INVENTION

The shortcomings hereinbefore mentioned of the conventional door operating member are effectively solved by the door operating mechanism made in accordance with the present inventive concept adapted to be employed in the console of an electric audio apparatus such as a component type stereo. By the mechanism herein described, the door is held in its closed position by a magnetic device. When the closed door is pushed, the magnetic force at one end of an operative member of the magnetic device will be greatly decreased. The door will then automatically be popped open by means of a coil spring operatively contained in a cylindrical casing of the mechanism.

OBJECTS OF THE INVENTION

One of the objects of the present invention is to provide a door operating mechanism that will automatically pop a door open.

A further object of the present invention is to provide a door opening mechanism which will not interfere with the plates making up the console when the console is broken down for packing or taken apart.

Other objects, features and advantages of the present invention will become apparent from the following description and with reference to the accompanying drawings, in which:

DETAILED DESCRIPTION

Figure 1:
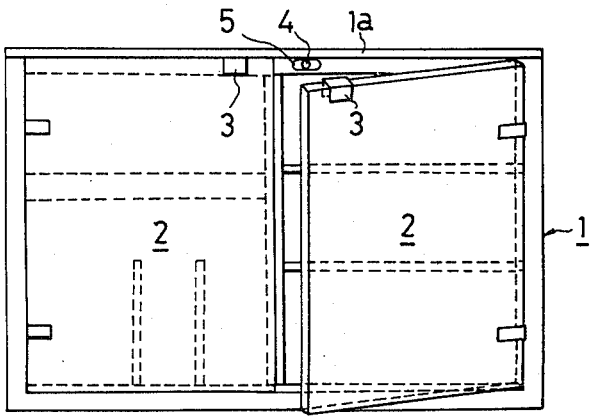
FIG. 1 is a front view of the console of an electrical audio apparatus such as a stereo set in which a door operating mechanism made according to the present inventive concept.
Figure 2:
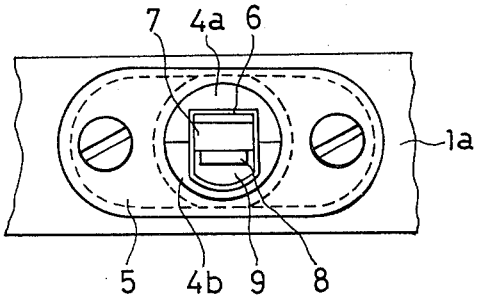
FIG. 2 is a partly enlarged front view of the door operating mechanism.

The door operating mechanism embodying the present inventive concept is held in a recess 1*b* formed in an upper plate of a console of an audio stereo set. The recess 1*b* faces a metal material 3 mounted on an upper edge of a door 2 of the console.

A casing 4 for the door operating mechanism is inserted in the recess 1*b*. The casing rear end portion abuts against a bottom of the recess 1*b*, and a front end porion of the casing engages a front plate 5 with a central aperture disposed around a front end portion of recess 1*b*. The casing is preferably constructed by bonding the two longitudinal edges of half cylindrical portions 4*a* and 4*b*, i.e., portions having an arch-shaped cross-section and made, for example of ABS synthetic resin.

A magnet 7 is mounted on the inner face of one of the half-portions 4*a* so as to protrude slightly from the front end of the casing, and, the magnet 7 is able to move a small distance in its longitudinal direction. On one side of the magnet 7 is bonded a supplemental magnetic metallic piece 6. Within the cylindrical casing 4 an elongated operative member 9 is reciprocally mounted. Opertive member 9 has an elongated aperture 9*a* at its intermediate portion. Between the rear end of the operative member 9 and the bottom of the cylindrical casing 4 is disposed a compression spring 15. A main magnetic responsive piece 8 made of metal is affixed to the front end of the operative member 9 so as to contact the under surface of the magnet 7.

Within the casing 4 there is also a push-latch mechanism which includes an engagement piece 11 pivotally mounted on an intermediate portion of the operative member 9 by means of a pin 16, overlapping with the elongated aperture 9*a*. A torsion spring 10 is interposed between the opertive member 9 and a projection 11*a* of the engagement piece 11 for biasing the engagement piece 11 in a clockwise direction, and an engagement pin 12 which extends downwards from cylindrical half-portion 4*a*. This engagement pin 12 protrudes at the front of the engagement piece 11 through the elongated aperture 9*a*. The engagement piece 11 has a curved portion 11*b* at its front edge crossing over the elongated aperture 9*a*, a zigzag slot 13 cut or formed from the end of the curved portion 11*b* to the inner side of the engagement piece 11, and a cut-raised portion 14 formed at one side of an end portion 13*e* of the zigzag slot 14 by cutting in the material of the engagement piece 11 by raising the end portion of the cut portion.

Also, the engagement piece as hereinbefore described may be pivotally mounted on the casing 4 and the engagement pin 12 may be fixed to the operative member 9.

The push-latch mechanism according to this arrangement has a similar functional effect as the first arrangement described.

OPERATION OF THE INVENTION

The operation of the invention will be best understood by a study of FIGS. 3 and 5 and FIGS. 4 and 6.

Figure 3:
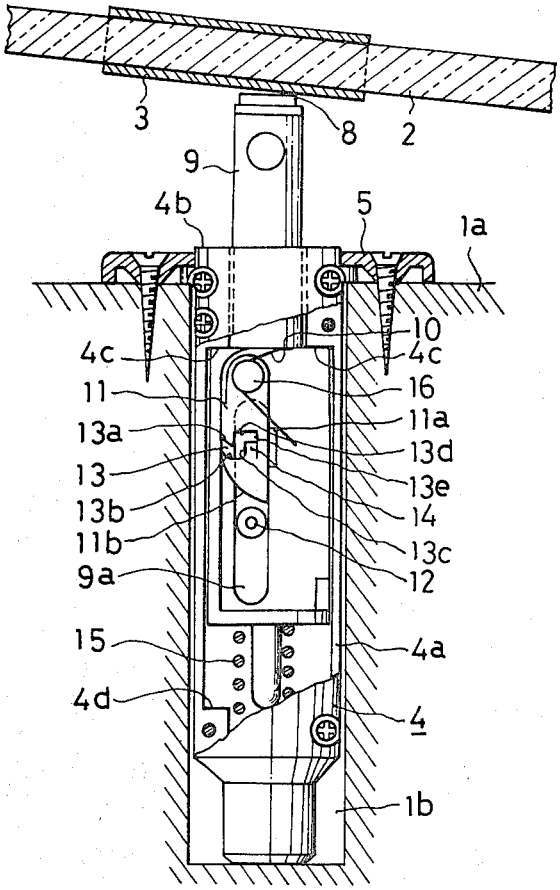
FIG. 3 is a sectional elevational view of the door operating mechanism showing its open position.
Figure 4:
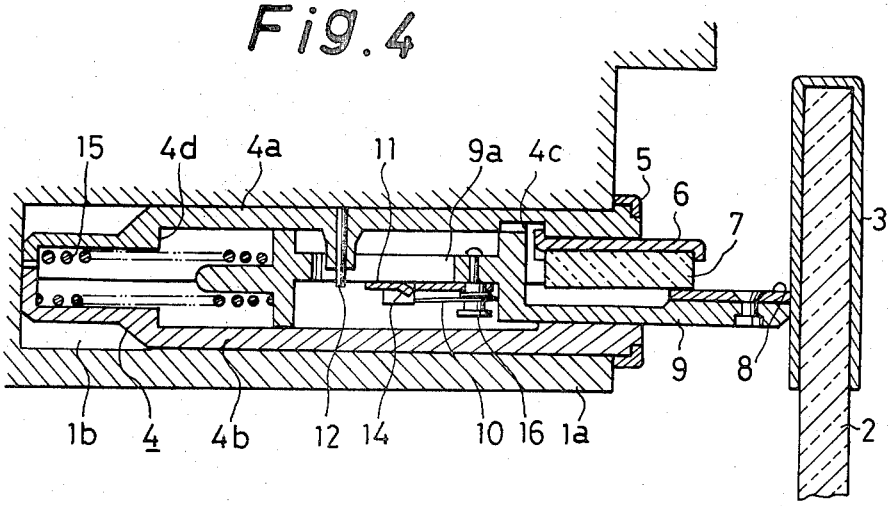
FIG. 4 is a bottom sectional view of FIG. 3.

As seen in FIG. 3 showing a positional relationship of the door 2 and the console 1, when the door 2 is pushed towards a closed-door position by hand, the metal material 3 contacts the front end portion of the operative member 9 which extends through plate 5 from the casing 4 and pushes the operative member 9 inwards or to the rear so that the operative member 9 backs into the casing 4 against the resistance of the coil compression spring 14. As a result, the curved portion 11*b* of the engagement piece 11 abuts the engagement pin 12 which extends through the elongated aperture 9*a* formed in operative member 9.

Figure 5:
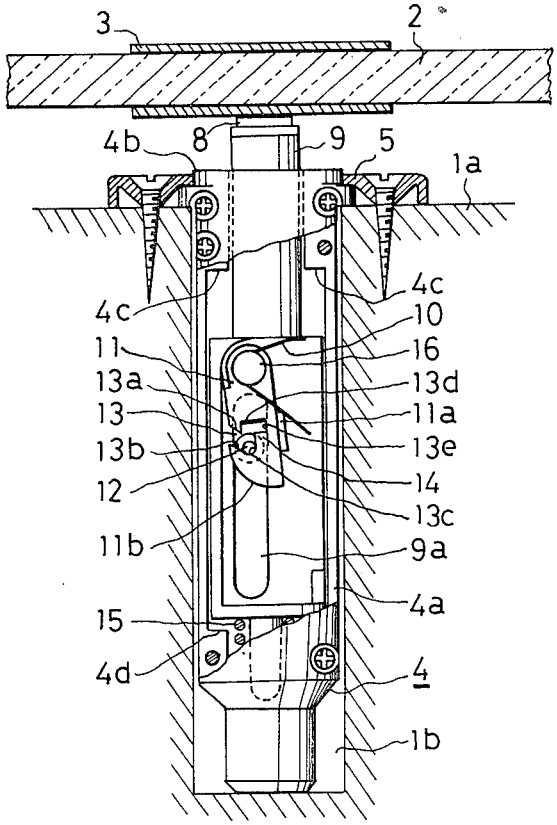
FIG. 5 is a sectional elevational view similar to FIG. 3 but showing the door in its closed condition.
Figure 6:
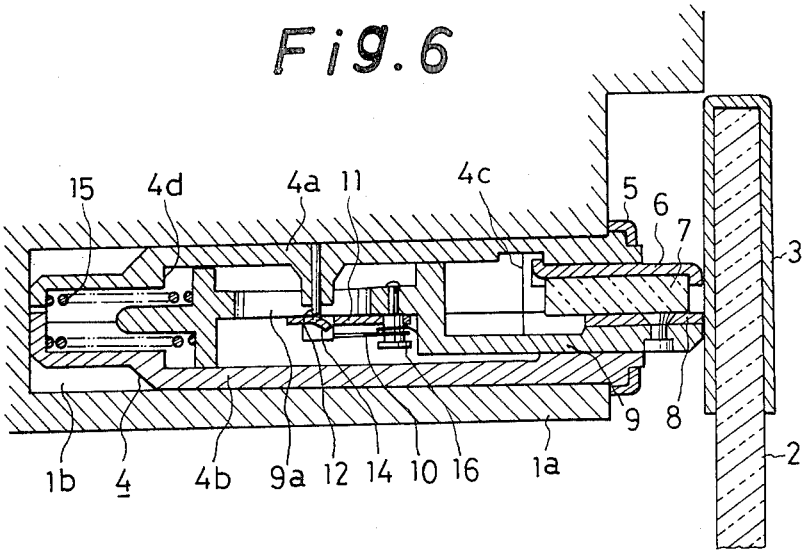
FIG. 6 is a sectional elevaional view similar to FIG. 4 but again showing the door in its closed condition.

Therefore, the engagement piece 11 swings counter-clockwise as shown in FIG. 3 resisting the force of the coil torsion spring 10. With the retreating motion of the operative member 9 the counter-clockwise swinging motion of the engagement piece 11 advances. The inner shape of the casing 4 is so constructed as to cause the engagement pin 12 to fall in the zigzag slot 13 just before the operative member 9 abuts against the stopper portion 4*d* formed in the inner space of the casing 4 or the door 2 abuts against the front portion of the console 1. Thus, the engagement piece 11 swings back or clockwise a short distance, owing to the resilient force of the coil torsion spring 10 and a sliding motion of the engagement pin 12 along the zigzag slot 13. The engagement pin 12 is stopped when it contacts a convex portion 13*a* of a first zigportion of the zigzag slot 13. In this condition, the hand is released from the door, pushing force is applied against the door 2 and the door 2 is released. The operative member 9 then goes back to its original position a short distance by means of the coil torsion spring 10 until the engagement pin 12 abuts against an edge 13*c* situated adjacent to the first curved portion 13*b*. Then, the engagement piece 11, as shown in FIG. 5, is engaged at the first curved portion 13*b* by the engagement pin 12 and therefore, the operating member is latched at the position through the engagement piece 11 by means of the engagement pin 12.

Accordingly, in this situation, the main magnetic responsive piece 8 made of metal which contacts the metal material 3 on the door 2 has its maximum contacting area in contact with magnet 7. This increases the magnetic force and simultaneously the metal material 3 contacts the supplemental megnetic responsive piece 6 which contact the magnet 7. Therefore, the door 2 is firmly held at the closed position.

When the door 2 is again pusbed by hand and released, the operative member 9 again goes back a little until the engagement pin 12 reaches an edge of a second curved 13*d*, thereupon the engagement pin 11 swings a little in a clockwise direction until the engagement pin 12 abuts against the end portion 13*e* of the zigzag slot 13. However, as the cut and raised portion 14 is formed at the one side portion of the end portion 13*e*, the engagement pin 12 slips along an under surface of the cut and raised portion 14, raising the engagement piece 11 slightly and accordingly the operative member 9 is completely released from the latching engagement of the engagement pin 12. Owing to the resilient force of the coil compression spring 15 applied to the operative member 9, operative member 9 is projected forward from the position shown in FIG. 6 and pushes the door 2, breaking the magnetic force between the metal material 3 and the supplemental magnetic responsive piece 6. Then, the operative member 9 is stoped by the abbuting contact between a stopping portion 4*c* formed within the inner space of the casing and a shoulder formed on the operating member 9. In this situation, the contact area between the magnetic responsive piece 8 and the magnet 7 becomes very small so that the magnetic force acting on the main magnetic responsive piece 8 is suddenly decreased and does not have a sufficient attractive force to firmly attract the door 2, i.e., the metal material 3 on the door. Accordingly the door 2 opens automatically, i.e., the door pops open without any pull by hand being necessary to release the magnetic coupling between the magnet 7 and the main magnetic responsive piece 8.

It is to be observed that by properly determining the length of the main magnetic responsive piece 8 and/or the magnet 7, when the operative member 9 moves in the forward direction to open the door 2, the contact area between both of these members is decreased to substantially zero and a more effective motion to open the door of the consol is obtained.

Additionally, the casing 4 is contained in an upper plate 1*a* of the consol 1. The door operating mechanism does not protrude to the lower surface of the upper plate 1*a*. Therefore, the door operating mechanism does not interfere with the packing of the console when the console is taken apart into its component plates.

Although certain structures have been shown and described in detail in connection with the embodiments shown, it will be understood that changes may be made in the design and arrangement of parts without departing from the spirit of the present invention.

What is claimed is:

1. A door operating mechanism having means for magnetically engaging a piece of metal material mounted on a door, said mechanism comprising in combination:

(a) an elongated hollow casing with a closed rear end and an open front end, said front end being disposed to be opposite said metal material when said door is closed;

(b) a magnet with a flat face for supplying a magnetic energy field to by used in holding said metal material magnetically;

(c) an operative member in said casing with a member front end having a main magnetic responsive piece with a piece face disposed alongside said magnet flat face at said front end, said piece being designed to carry magnetic energy to said metal material when pressed against said front end, the strength of said magnetic energy field depending on the contact area between said magnet flat face and said piece face;

(d) a coil compressing spring at the rear of said casing adapted and disposed to longitudinally move said operative member within said casing; and, (e) a push-latch mechanism in said casing including: and elongated aperture (9*a*) intermediate the ends of said operative member, on an intermediate portion thereof, an engagement piece (11) pivotally mounted on said intermediate portion overlapping said elongated aperture (9*a*), a torsion spring (10) interposed between said operative member and the engagement piece (11) for biasing the engagement piece (11) in one direction, an engagement pin (12) protruding from the engagement piece (11) through said elongated aperture (9*a*), a curved portion (11*b*) along an edge of said engagement piece (11) crossing over said elongated slot (9*a*), a zigzag slot (13) at the end of said curved portion (11*b*) extending to the inner side of the engagement piece (11) and a raised portion (14) defined at an end (13*e*) of the zigzag slot (13) thereby to latch said operative member when the operative member is first pushed inwardly and to release said operative member when the operative member is again pushed inwardly so as to decrease the magnetic coupling between the magnet and said main magnetic responsive piece by decreasing the contacting area therebetween.

2. A door operating mechanism as claimed in claim 1 wherein said casing is a cylindrical casing having the longitudinal edges of half hollow cylinders bonded together.

3. A door operating mechanism as claimed in claim 1 including a supplemental magnetic responsive piece disposed on the other side of said magnet from the side in contact with said main magnetic responsive piece.

4. a door operating mechanism as claimed in claim 1 wherein said magnet or said supplemental magnetic responsive piece can move a short distance longitudinally.

* * * * *